US005221892A

United States Patent [19]

Sullivan et al.

[11] Patent Number: 5,221,892

[45] Date of Patent: Jun. 22, 1993

[54] FLUX COMPRESSION TRANSFORMER

[76] Inventors: Richard A. Sullivan, 2517 Woodland Rd., Manchester, N.J. 08733; Melvin K. Silverman, 18540 NE. 20th Ct., North Miami Beach, Fla. 33179

[21] Appl. No.: 770,901

[22] Filed: Oct. 4, 1991

[51] Int. Cl.[5] ..... G05F 7/00

[52] U.S. Cl. ..... 323/362; 336/110; 336/182; 336/229

[58] Field of Search ..... 336/229, 182, 110; 323/355, 362

[56] References Cited

U.S. PATENT DOCUMENTS

| | | | |
|---|---|---|---|
| 4,006,041 | 2/1977 | de Rivas | 323/362 |
| 4,077,001 | 12/1978 | Richardson | 336/110 |
| 4,904,926 | 2/1990 | Pasichinskyj | 323/362 |

*Primary Examiner*—William H. Beha, Jr.
*Attorney, Agent, or Firm*—M. K. Silverman

[57] ABSTRACT

A direct current flux compression transformer includes a magnetic envelope having poles defining a magnetic axis and characterized by a pattern of magnetic flux lines in polar symmetry about the axis. The magnetic flux lines are spatially displaced relative to the magnetic envelope using control elements which are mechanically stationary relative to the core. Further provided are inductive elements which are also mechanically stationary relative to the magnetic envelope. Spatial displacement of the flux relative to the inductive elements will cause flow of electrical current. Further provided are magnetic flux valves which provide for the varying of the magnetic reluctance to create a time domain pattern of respectively enhanced and decreased magnetic reluctance across such magnetic valves and, thereby, across the inductive elements. A flow of electric current is generated without mechanical motion of inductive elements relative to the magnetic envelope. The output waveform at the secondary can be taken in various combinations of polarity, voltage and current.

13 Claims, 8 Drawing Sheets

FLUX COMPRESSION TRANSFORMER

BACKGROUND OF THE INVENTION

The present invention relates to a solid-state direct current transformer. More particularly, the instant invention makes use of a proposed extension of Faraday's Law, this extension constituting a proposition to effect that a changing magnetic field, relative to an electrical conductor, will induce an electric field therein, regardless of whether or not the source of the magnetic field undergoes physical movement. It is, through the present invention, suggested that to generate electric current, it is only necessary that a magnetic field move relative to an inductive conductor and that, consequently, it is not necessary that the source magnet itself move to induce an electric field or current.

The most relevant prior art known to the inventors comprises U.S. Pat. No. 4,006,401 (1977) to De Rivas, entitled Electromagnetic Generator; U.S. Pat. No. 4,007,001 (1977) to Richardson, entitled Electromagnetic Converter with Stationary Variable Reluctance Members, and U.S. Pat. No. 3,368,141 (1969) to Subieta-Garron, entitled Transformer with Permanent Magnet.

The above reference to De Rivas discloses an electric magnetic generator which utilizes a permanent magnet and inductive means to "alternate by switching" the flux of the permanent magnet, thereby generating alternating current at the outputs thereof. Said reference, as well as Richardson, represent the only known direct attempts in the prior art to generate electricity by non-moving means through the manipulation of the magnetic field of a permanent magnet. In De Rivas, inductive means are used for the purpose of "magnetic switching". As such, inductive and related heat losses would produce a questionable level of performance.

The above reference to Richardson discloses and "energy conversion system" in which the flux of the permanent magnet is, as in De Rivas, "shifted" by inductive means. However, unlike De Rivas, Richardson makes use of a lamellar core which acts as a bi-stable magnetic valve placed in the proximity of the output windings to carry-off the induced power from the system.

Richardson accurately identifies many key concepts of power conversion by non-moving systems and recognizes the need to optimize geometry, materials, control, timing and other factors which must be taken into consideration in the efficient generation of power through the shifting, oscillation and/or rotation of the magnetic field of a fixed permanent magnet.

The above reference to Subieta-Garron discloses a transformer in combination with a permanent magnet in which the flux of a permanent magnet is "selectively added" to the flux induced by the primary windings of the transformer, thereby increasing the power factor of the transformer. In all above cited cases inductive conversions of electrical power are accomplished by means of expansion and contraction of magnetic fields. Sequential expansion and contraction out of and into inductive structures comprising coiled inductors situated transverse to the plane of such expansion and contraction, induces a flow of electrical current within such inductive coil structures.

The present invention, in distinction makes use of the polar axial rotation of a steady state magnetic field across a radial array of planer mesh-like inductive structures situated transverse to the plane of such rotation.

It is upon the teachings of Richardson, De Rivas and Subieta-Garron that the invention herein is most directly based.

SUMMARY OF THE INVENTION

The instant invention comprises a solid state flux compression direct current transformer having a stationary magnetic envelope as the primary thereof, said envelope defining both a magnetic axis and a pattern of magnetic flux lines in polar symmetry about said axis. Further included in the transformer are control means for polar and axial spatial displacement of said flux lines relative to said stationary magnetic core, said control means being stationary relative to said core. Further provided are inductance means in electromagnetic communication with said flux lines, said means also being stationary relative to said core. Selective time domain polar and axial displacements of said flux lines relative to said inductance means initiate a flow of electrical energy within the transformer, in which the output of the inductance means are the secondary of the transformer.

Accordingly it is an object of the present invention to provide a solid state d.c. transformer which can provide a range of output waveforms, polarities, voltages, and currents.

It is another object of the invention to provide a d.c. transformer either or both electromagnets and pole magnets by which electrical energy is induced through the controlled rotation of magnetic flux lines while said magnets and/or electromagnets are maintained in a stationary orientation relative to the lines of magnetic flux.

It is further object to provide a d.c. electromagnetic pole magnet which may or may not be in combination with a permanent magnet or singular permanent magnet as a flux source, in which the magnitude of energy flow of the transformer increases as a function of the rate of rotation of lines of magnetic flux relative to the axis of the magnetic envelope.

The above and yet other objects and advantages of the invention will become apparent from the hereinafter set forth Detailed Description of the Invention, the Drawings, and Claims appended herewith.

DETAILED DESCRIPTION OF THE INVENTION

Figure 1:
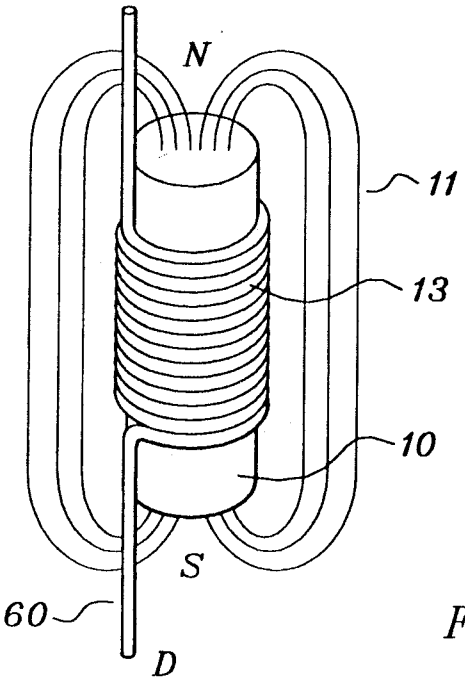
FIG. 1 is a representational view of a d.c. electromagnet in combination with a permanent magnet and its magnetic field.

With reference to FIG. 1 there is shown a representative radial cross section of a magnetic field 11 projected by a d.c. electromagnet in combination with a permanent pole magnet 10. It is to be appreciated that field 11 exhibits radial and axial symmetry along all radial and axial cross sections about the magnet 10 and that windings 13 may surround a permanent magnet core, or core of other material. Alternatively pole magnet 10 may be permanent magnet having no electromagnetic winding 13. Where an electromagnet is used, the leads C and D of winding wire 60 act as the system input.

Figure 2:
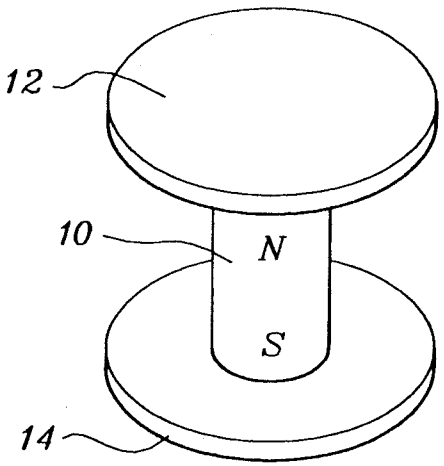
FIG. 2 is a representational view of said pole magnet having associated therewith integral upper and lower pole shoes in accordance with the present invention.

With reference to the representational view of FIG. 2, there is shown an upper pole shoe 12 and lower pole shoe 14, each of said pole shoes being axially centered relative to the magnetic axis of magnet 10, and in magnetic communication with the respective north and south poles of magnet 10. It is to be further noted that said pole shoes 12 and 14 are, preferably, formed of a paramagnetic material such that the pattern of magnetic flux carried thereby will be a direct function of the magnetic field applied thereto, that is, the magnetic characteristic of the pole shoes will be proportional to the applied field such that, in the absence of a field at any given radial location on the pole shoe, no magnetic field will be induced into radial segments of the pole shoe.

Figure 3:
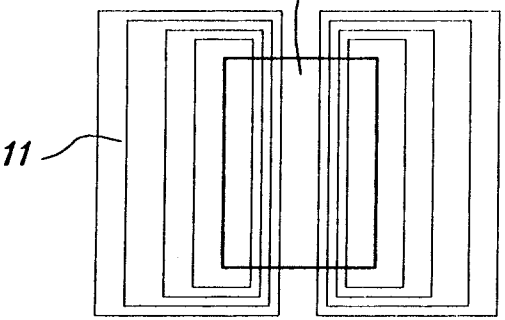
FIG. 3 is a represented radial cross-section of the magnetic field of the pole magnet formed by the addition of the pole shoes to the structure. (Pole shoes not shown).

With regard to FIG. 3, there is shown a hemispheric cross-section of the magnetic field pattern created by the presence of pole shoes 12 and 14, although the pole shoes are not, as such, shown in FIG. 3.

Figure 4:
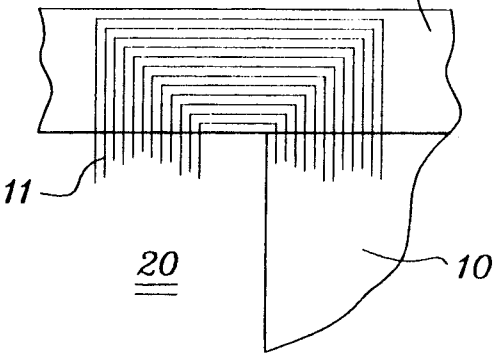
FIG. 4 is an enlarged radial cross-sectional view of a region of magnetic flux lines passing through the upper pole shoe from said pole magnet.

In FIG. 4 is shown an enlarged radial cross-sectional view showing the path of magnetic flux from within pole magnet 10 into upper pole shoe 12, across one radius thereof and, therefrom, downward into a location occupied by a winding cell 20, more fully described below.

Figure 5:
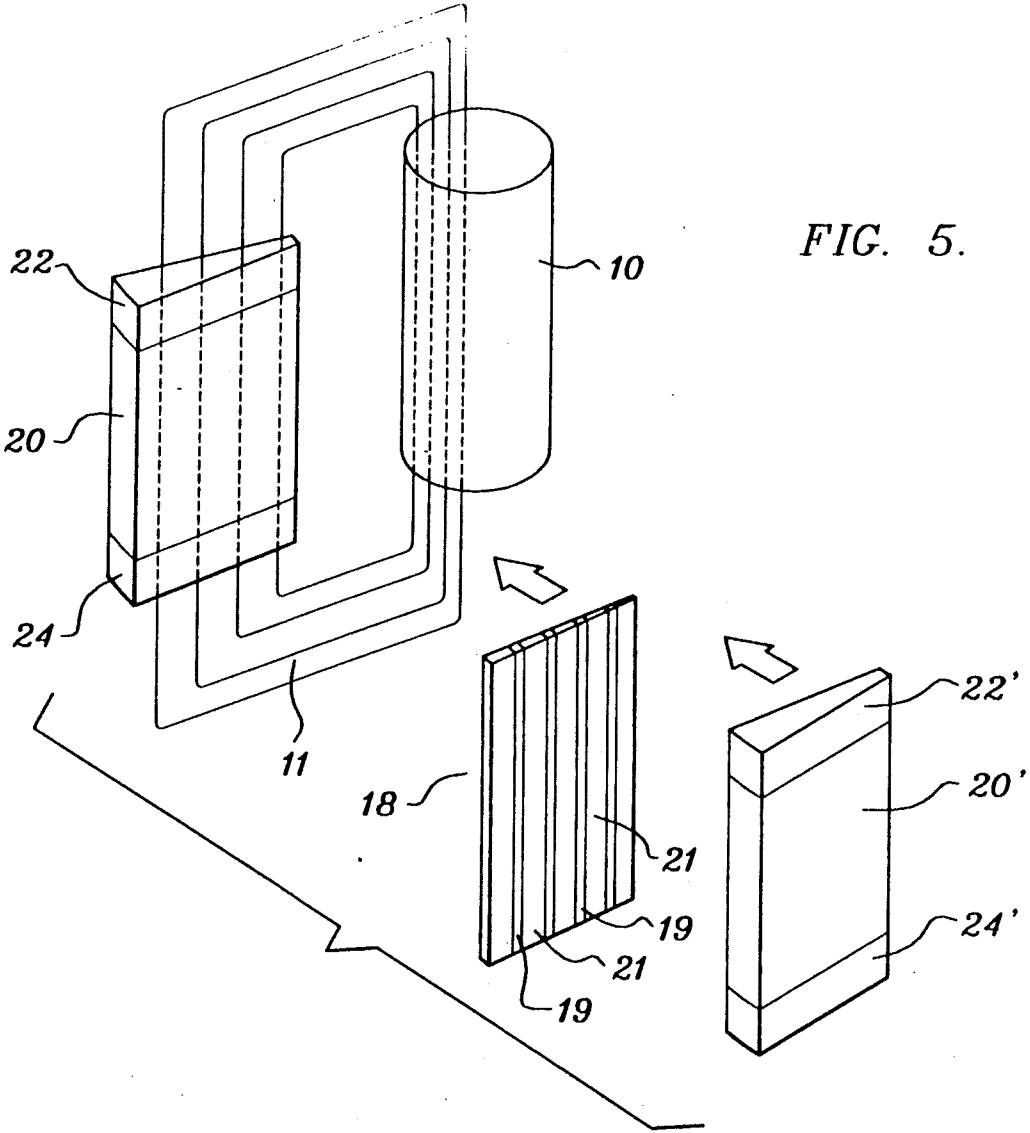
FIGS. 5 and 6 are exploded schematic views of components of the inventive transformer and their relative magnetic communication.

With reference to the exploded view of FIG. 5 there is shown a partial exploded view of the invention which includes pole magnet 10, winding cells 20, upper magnetic flux valve (MFV) group 22, lower magnetic flux valve (MFV) 24, and magnetic insulator 18.

It is to be noted that selective magnetic insulator 18 consists of radially interdigitated axially disposed strips of magnetic insulator 21 and a magnetic conductor (such as a paramagnetic material) 19. The function of the polarly interdigitating arrangement of magnetic conductive and non-conductive elements 19 and 21 respectively is to focus flux lines 11 within the axial polar segment defined by each magnetically conductive strip 19 as rotation of the flux lines 11 (more fully described below) occurs between polarly successive winding cells and MFV groups 20 and 20.

Figure 6:
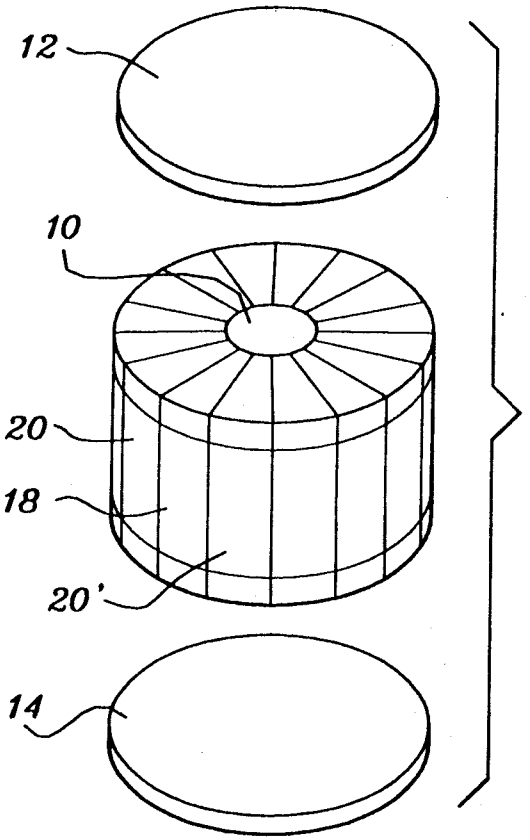

In FIG. 6 there is shown a partial assembly view illustrating the matter in which the various axial polar segments defined by said combinations of upper MFV groups 22, winding cells 20, and lower MFV groups 24 on the one hand, and selective magnetic insulators 18, on the other hand, appear when assembled into a complete transformer. In other words, it is to be appreciated that FIG. 6 consists of a plurality of polar segments, similar to slices of a cylindrical cake, in which the various slices consist of a plurality of inter-digitated groups of upper MFV's/winding cells/lower MFV's on the one hand, and selective magnetic insulators 18 on the other hand. As may be noted, the number of winding cell groups 20 equal the number of selective magnetic insulator 18 and, at the center thereof, is the above described pole magnet 10 having upper pole shoe 12 and lower pole shoe 14.

Figure 7:
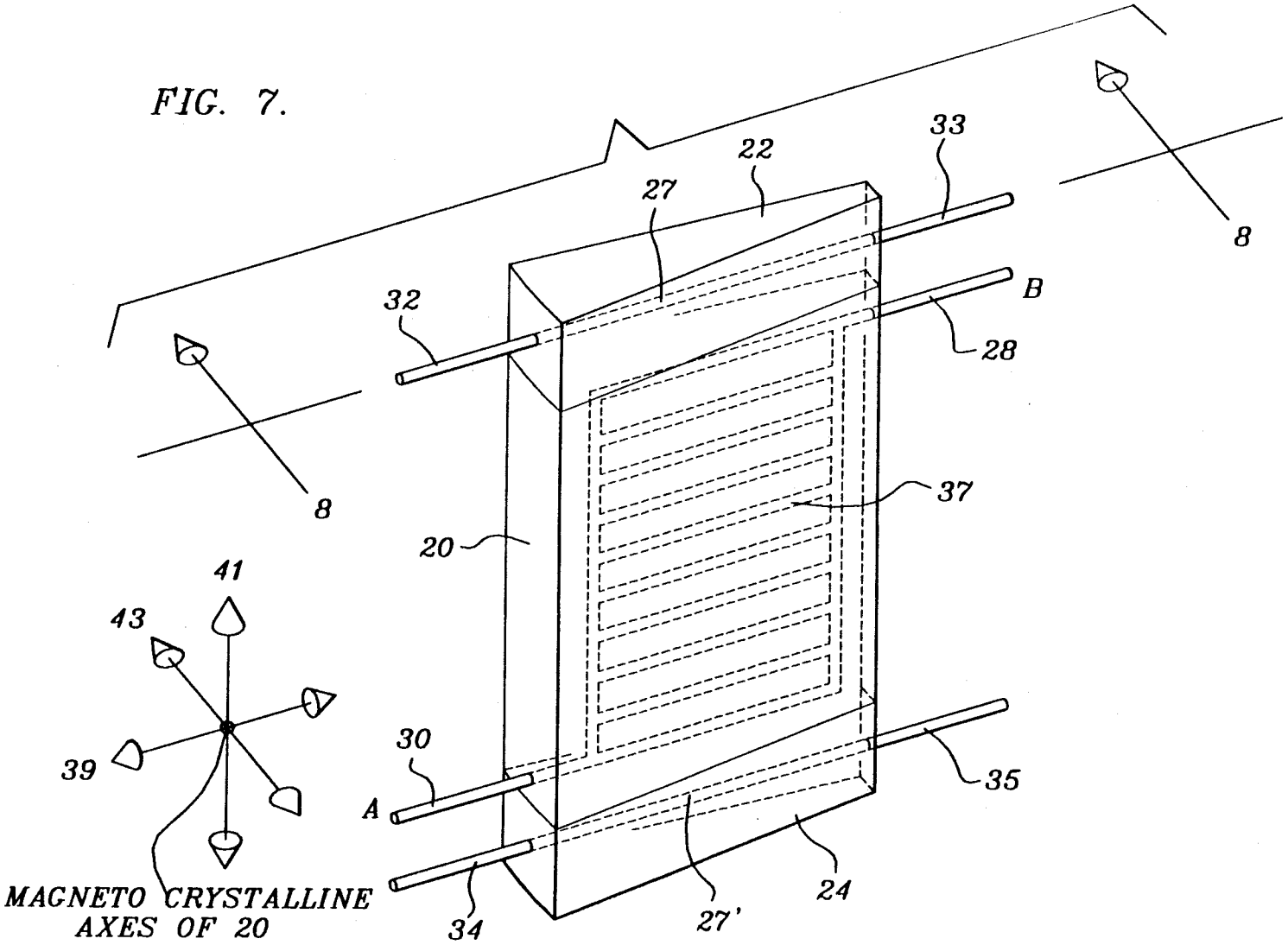
FIG. 7 is an enlarged schematic view of a typical winding element and the upper and lower magnetic flux valve associated therewith.

FIG. 7 is an enlarged representational view of a winding cell assembly, such assembly comprising said upper MFV 22, said winding cell 20, and said lower MFV 24. Within upper MFV 22 is provided a radial conductor 27 having an electrical input 32 and an electrical output 33. Conversely, lower MFV 24 is provided with radial electrical conductor 27′ having an input 35 and output 34.

Between upper and lower MFV's 22 and 24, and in magnetic communication with the inner surfaces thereof, is said winding cell 20. Said winding cell exhibits a particular geometry including inductive means 37 positioned within a radial plane of the system. Said means 37 comprises a ladder or mesh-like structure of the type illustrated in FIG. 7. It is to be appreciated that various types of inductive structures may be placed within the envelope defined by pie-slice like geometry of FIG. 7. See, for example, U.S. Pat. Nos. 4,543,553 and 4,803,453 which relate to laminated and chip-type inductors.

Inductive means 37 is surrounded by a magnetically permeable material and, preferably, a crystalline paramagnetic material in which a magneto-crystalline axis 39 defines a so-called hard axis of magnetization while axes 41 and 43, which are transverse to said axis 39, define axes of so called easy magnetization. It is to be appreciated that in paramagnetism, magnetization only occurs in proportion to the applied magnetic field. Accordingly, in terms of crystallography, said magneto-crystalline axes 39, 41 and 43, axis 39 would represent an axis of low permeability (high coercivity), while axis 41 and 43 would represent axes of high permeability (in the presence of an external magnetic field). Certain materials and, in particular, rare-earth materials, having partially filled 3*d* and 4*f* electron shells respectively have been found to exhibit important paramagnetic properties. Crystalline forms of rare-earth compounds of such elements as cesium, samarium, europium, gadolinium, and yitrium have been shown to exhibit such axis-dependent paramagnetic properties. For a fuller discussion of the theory and application of paramagnetism, see Boudreaux, *Theory and Applications of Molecular Paramagnetism*, 1976, *Introductions to Solid State*

*Physics*, 6th ed., 1986, by Mattis, and *State Physics Source Book*, by Parker, McGraw Hill, 1988, pp. 210–214.

In addition to the use of crystals of rare-earth compounds, so-called semi-metals, in crystalline form, having axis dependent magnetic properties may be employed as is taught in U.S. Pat. No. 3,303,427 (1967) to Esaki, entitled Cryogenic Effect Semi-metal Electronic Elements.

In summary, through the use of an axis dependent paramagnetic material within winding cell 20, flux lines 11 passing between upper and lower MFV's 22 and 24 will be captured as such flux passes along axis 41. Further, as magnetic flux is (as is more fully described below) switched between polarly adjacent winding cells 20 and 20' flux will flow across magneto-crystalline axis 43. Accordingly, the movement of flux along either of said axis 41 or 43 will result in the cutting of said flux of the internal mesh-like, ladder-like (or other) structures of inductive means 37, thus giving rise to an electrical output across outputs 28 and 30, i.e., the secondary of the transformer.

Figure 8:
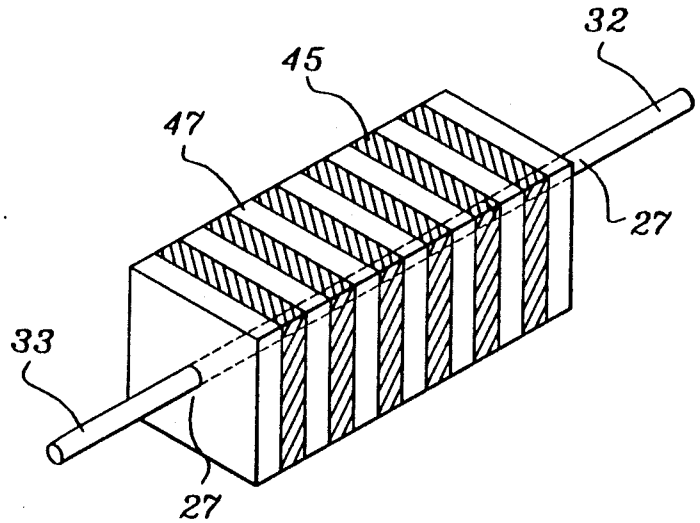
FIG. 8 is a representative enlarged radial cross-sectional view taken through a radius of a magnetic flux valve.

. FIG. 8 is a radial cross-sectional view along the center of conductor 27 or 27' within upper or lower MFV's 22 or 24, consisting of alternating layers of paramagnetic layers 45 and electrically conductive layers 47. When current is present between input 32 and output 33 of conductor 27, the layers 47 will be electrified thereby giving rise to an electrical field between said layers 47. This electrical field will have a transverse (radial) magnetic components, with the current running across conductor 27 by virtue of the law of Biot and Savoit. Thereby, the purpose of paramagnetic layers 45 is to provide a path for the magnetic fields, transverse to conductor 27, created by the electrodynamics of current and charge within wire 27 and electrically conductive layers 47.

Simply stated, conductor 27 experiences a flow of current, having a magnetic field, transverse to the direction of current flow. This field will thereby block the flux 11 from pole magnet 10 in the vicinity of the conductor. When no electrical current is present across conductor 27, the normal static pattern of magnetic flux (see FIG. 5 and 10) will be undisturbed as flux lines 11 simply pass into winding cell 20 and, more particularly, along axis 41 thereof. During transient periods (see FIGS. 12, 14 and 16) between static flux geometries, the flux lines will slide laterally along paramagnetic axial strips 19 of selective magnetic insulator 18 (see FIG. 5) and, therefrom, into the polarly adjacent winding cell 20'. This movement of the flux lines assures field continuity during angular displacement of the field.

Figure 9:
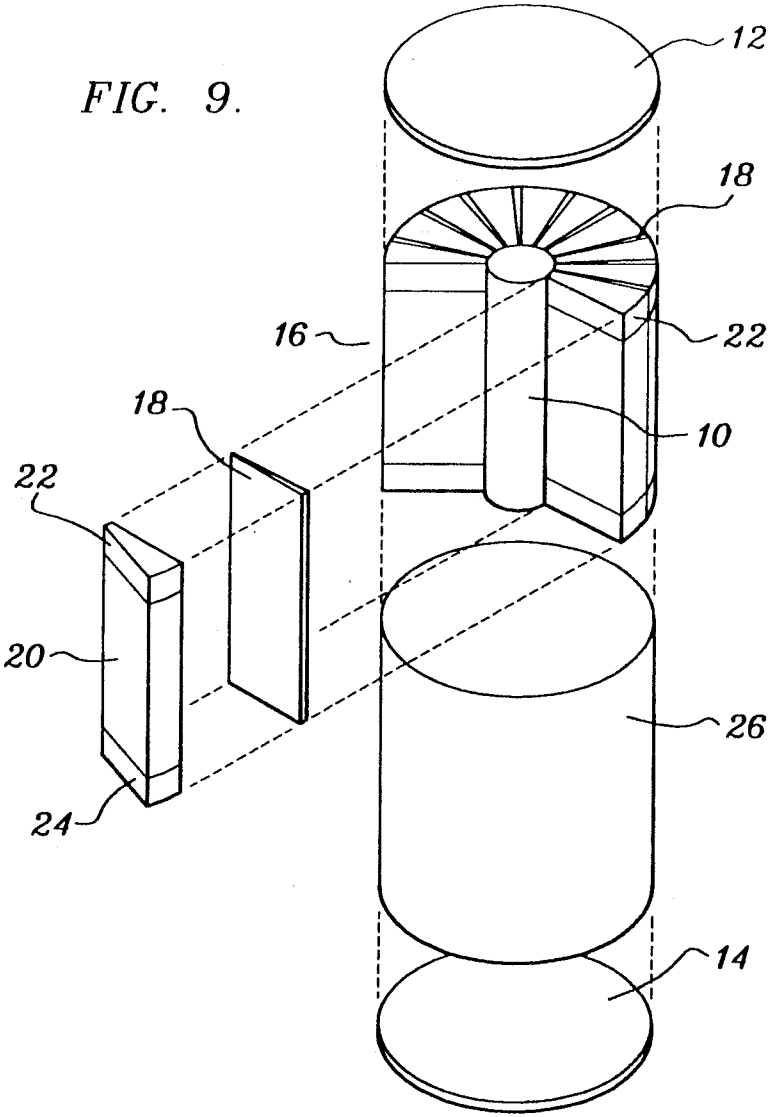
FIG. 9 is a combined respective assembly and exploded view of the inventive transformer.

With reference to the view of FIG. 9, there is shown a partially exploded view the gross elements of the transformer including a magnetically insulative canister 26, the purpose of which is to confine flux within the envelope defined by the geometry of upper pole shoe 12, said canister 26, and lower pole shoe 14. The transformer block 16 is comprised of winding cells 20 and magnetic insulators 18, surrounding pole magnet core 10.

Figure 10:
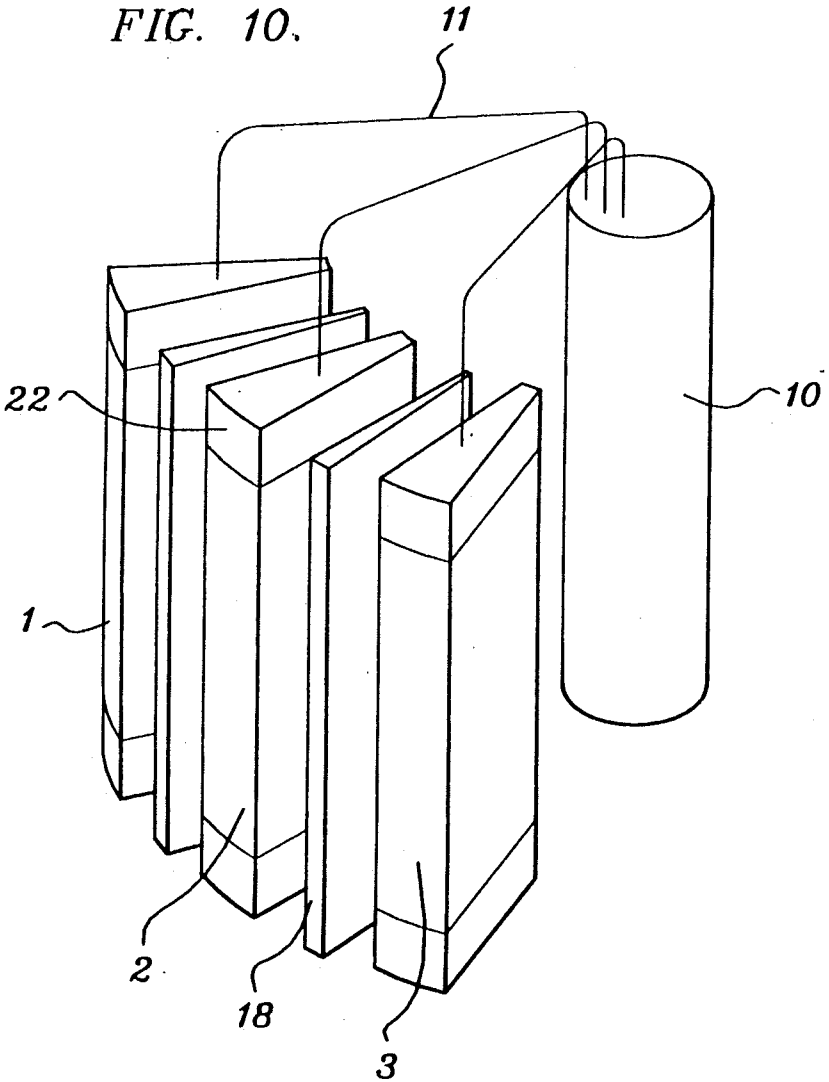
FIG. 10 is a conceptual exploded view showing the location of magnetic flux lines in the absence of a function of the magnetic flux valves.

With reference to FIG. 10, there is shown, in exploded view, a relationship between flux lines 11 and a number of polarly adjacent upper MFV's 22 and interdigitated selective insulator 18. FIG. 10 represents that pattern of flux which exist in the absence of any flow of electrical current across conductors 27 and 27' of FIGS. 7 and 8. In such a static mode, flux lines will pass thru MFV 22 along crystalline axis 41 of winding cell 20, and into lower MFV 24.

Figure 11:
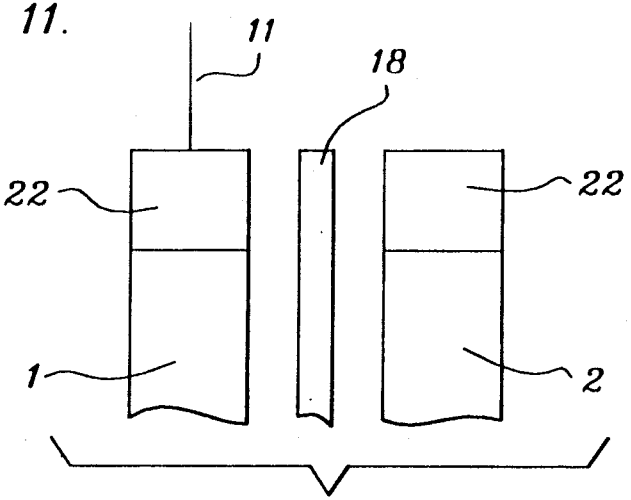
FIGS. 11 and 12 are conceptual views showing the operation of the magnetic flux valves.
Figure 12:
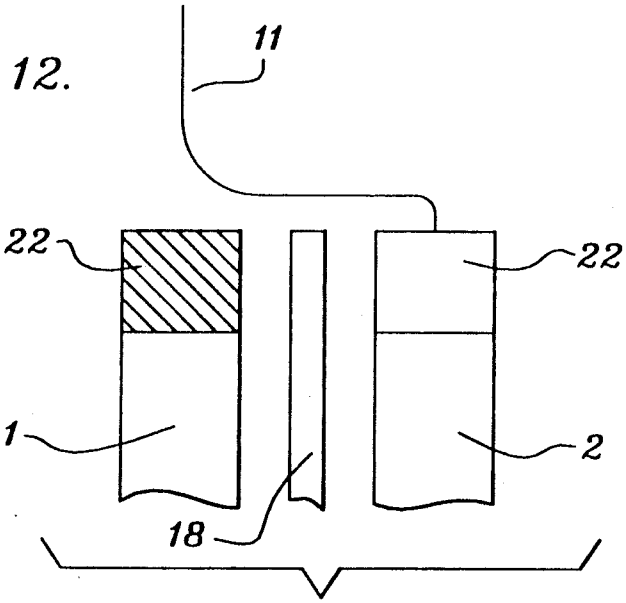

In FIG. 11 and 12 are conceptually shown the manner in which a given flux line can be polarly shifted from a winding cell 1, across insulator 18 and to a second adjacent winding cell 2. The condition of FIG. 11 corresponds to the MFV's in a de-energized state (the view also of FIGS. 5 and 10) while the view of FIGS. 11 and 12 is that the location of a given line of magnetic flux 11 will follow a path of least magneto-resistance. That is, where the MFV of winding cell 1 is activated. (FIG. 12), the transverse magnetic field generated by the structure shown in FIG. 8 will repel flux lines in the immediate vicinity thereof, thereby forcing such flux lines into the MFV of those pie slice-shaped winding cell assemblies 20 in which the MFV is not energized. The result is that of a polar displacement of any given magnetic flux line as a time domain function of the electronic control which the MFV's operate.

Figure 13:
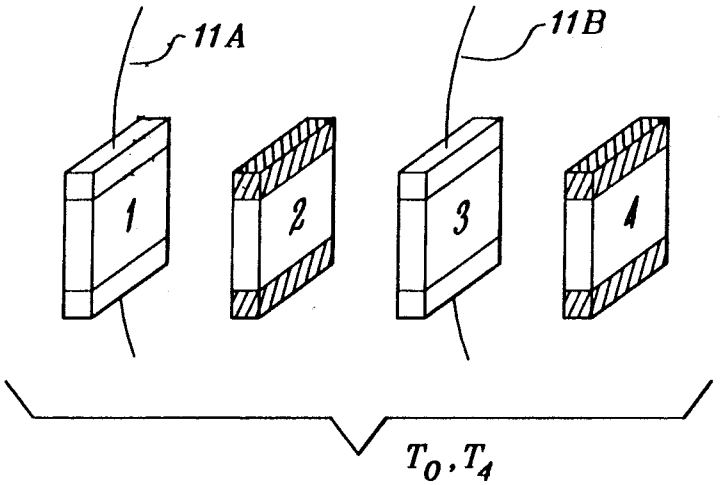
FIGS. 13 through 16 are representational views showing a flux displacement switching sequence according to the present invention.

A sequence of such domain control operation of the MFV's is shown in FIGS. 13 through 16, more particularly, in FIG. 13 is shown time domain conditions that may be termed $T_0$ and $T_4$ (later described). In $T_0$, winding cell assemblies 2 and 4 have energized their MFV's which, resultantly, produce a high magneto-resistance transverse to the direction of the radial conductors 27 therewithin. In other words, the MFV's which are darkened in the view of FIG. 13 are energized and, thereby, are in a magnetic flux blocking mode. When de-energized, flux lines 11A and 11B will follow their normal axial path through the paramagnetic conductors 45 (See FIG. 8) within the MFV's and into the winding cell within each winding cell assembly.

Figure 14:
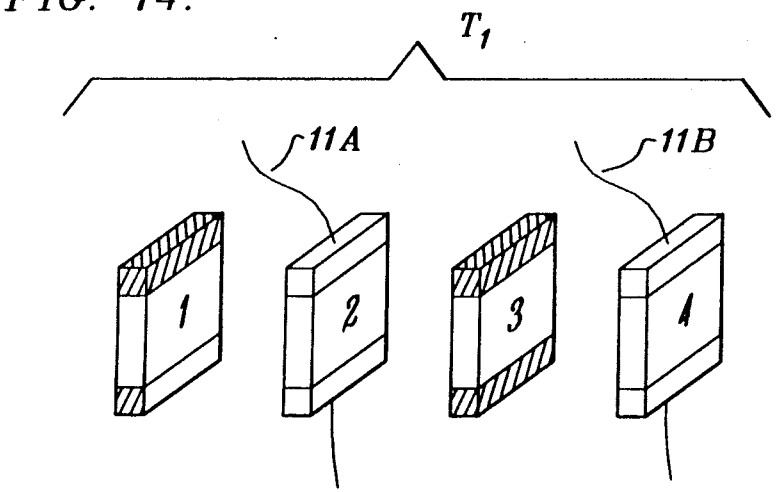

In FIG. 14 is shown the time domain condition $T_1$. Therein, winding cell assemblies 1 and 3 are energized thereby placing the MFV's thereof into a flux blocking mode. When this occurs, the condition above described with respect to FIG. 13 exists and, as such, the flux lines 11A and 11B will be polarly displaced to the nearest adjacent winding cell assembly in which the MFV's are note energized. $T_1$ is a transient state.

Figure 15:
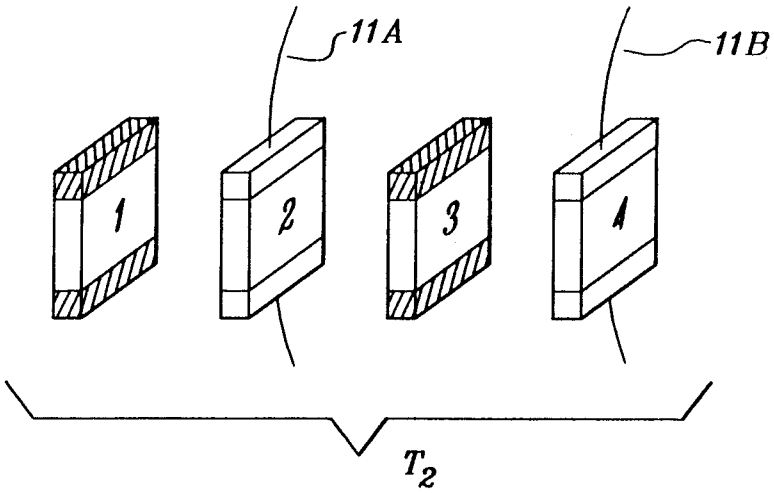

In FIG. 15 is shown a time domain situation $T_2$ in which a stable, or equilibrium magnetic state is attained by the magnetic flux lines 11A and 11B after the transient condition of FIG. 14 has passed. Through an appropriate choice of paramagnetic materials, switching times of a nanosecond can be achieved.

Figure 16:
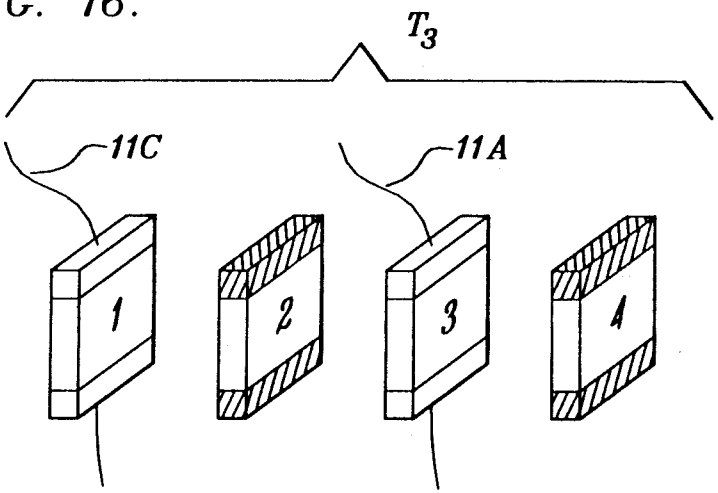

Shown in FIG. 16 is the $T_3$ time domain condition when the MFV's winding cell assemblies 2 and 4 have again been energized. That is, FIG. 16 shows the transient condition that exists between the time domain condition of FIG. 15 ($T_2$), and FIG. 13 ($T_4$). Flux lines 11A and 11C are seen depicted as they shift from one polar location to the next, in stepwise rotational fashion.

With reference to the enlarged winding cell assembly shown in FIG. 7, it is to be appreciated that polar movement, above described with respect to FIGS. 13 through 16, corresponds to magnetic flux movement primarily along magnetocrystalline axis 43 (the polar coordinate of the system) and, secondarily, along magnetocrystalline axis 41 (the axial component of the system).

Figure 17:
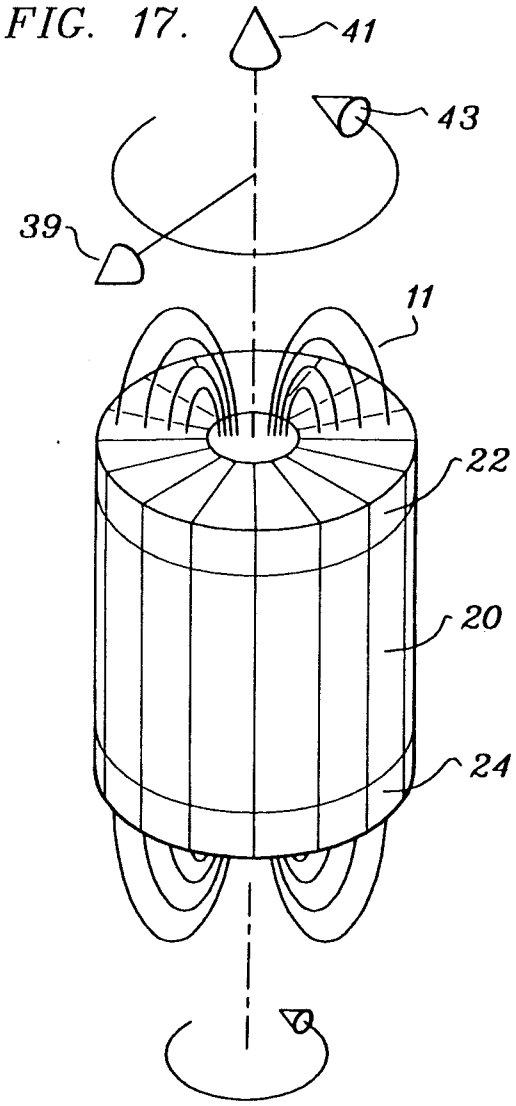
FIG. 17 is an assembled schematic view showing the axis of rotation of the magnetic flux lines in accordance with the present invention.

The above may be further understood with reference to FIGS. 7 and 17 in which the magnetocrystalline axes 39, 41 and 43 are shown in isometric view. Therefrom, it may be appreciated that the above described polar rotation of flux operates to induce current by the movement of flux lines (magnetically polarized and quanticized photons) across inductive means 37 while the naturally occurring component of magnetic flux, i.e., the component along axis 41, also operates to cut surfaces of the inductive means. The resulting stepwise rotation of what may be viewed as radial packets of flux thus transits components of flux movement along both axes 41 and 43, the result being a spinning magnetic field which, when intersected by inductance means 37, gives rise to an electrical current at outputs 28 and 30 (see FIG. 7), that is, across the secondary of the transformer. Further, the induced magnetic field surrounding each inductor means 37 aids in the evacuation of flux from each winding cell 20 as the MFV's are sequenced on, thereby causing flux to "slide" thru the winding cell to the next polarity adjacent winding cell, without "breaking" the flux line.

Figure 18:
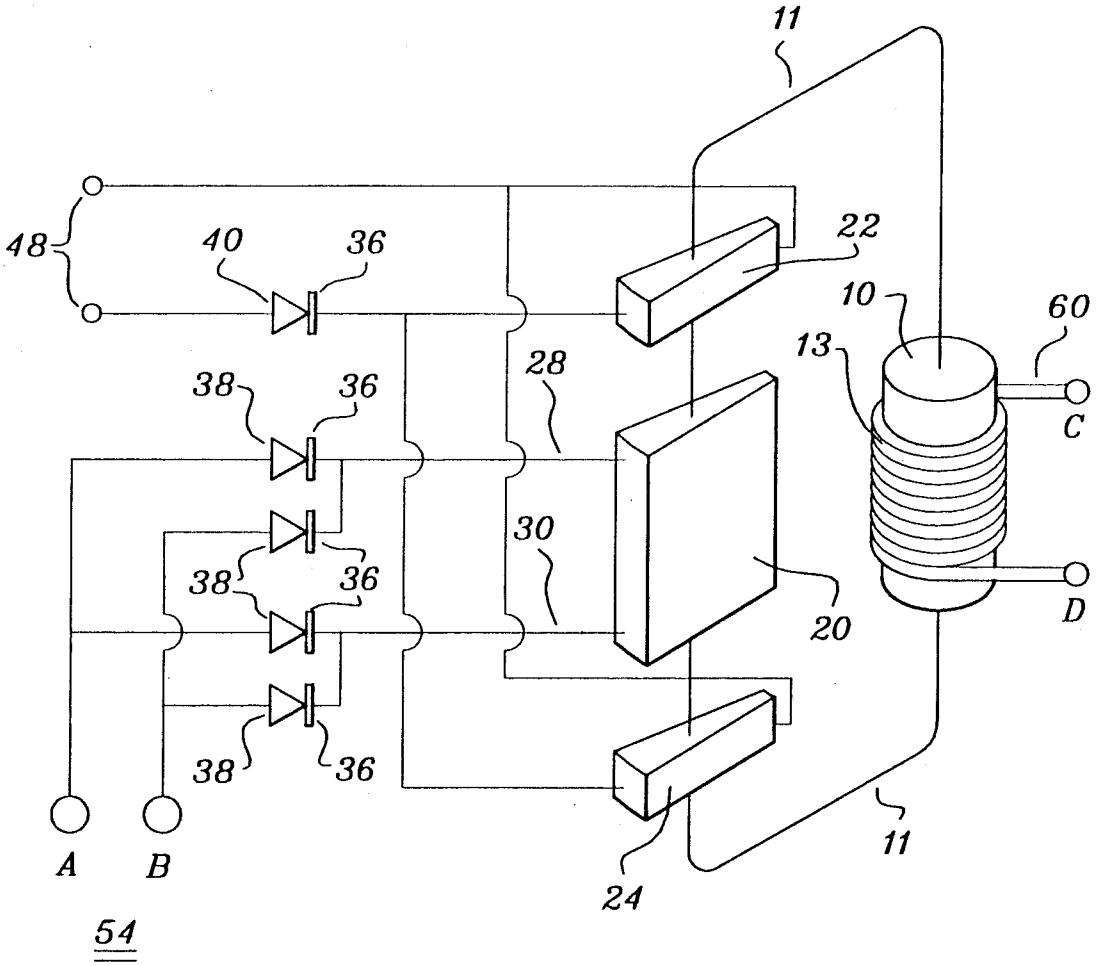
FIG. 18 is a conceptual view of the electronic control system of the inventive transformer.
Figure 19:
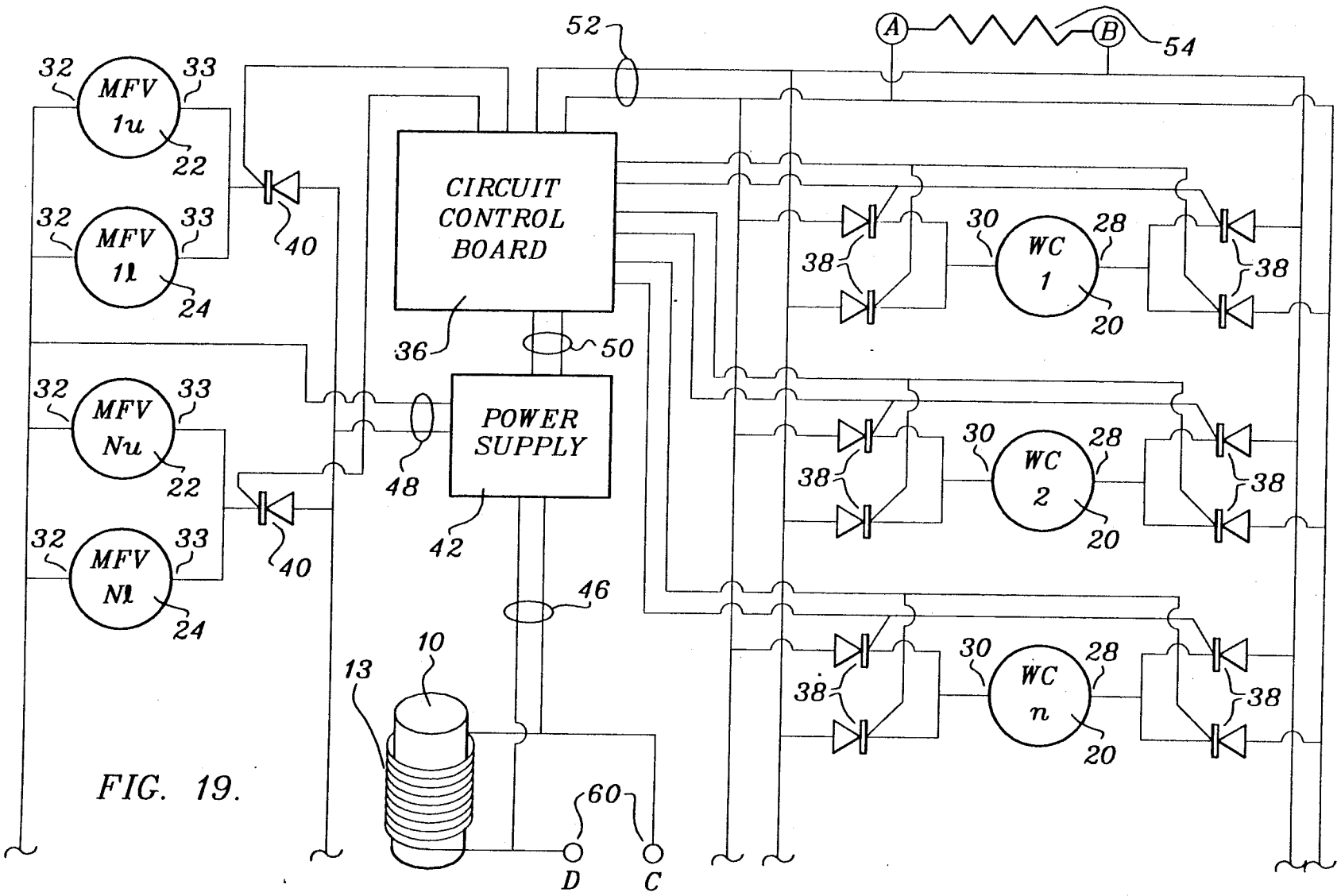
FIG. 19 is an electrical block diagram of an electronic control circuit of the inventive transformer.

The electronic control of the above described structure is shown in conceptual view in FIG. 18 and in the block diagram view of FIG. 19. It may be seen that upon actuation of a primary power source 60, (a d.c. input) there is provided power to a power supply 42 which, in turn, provides power through the MFV's 22 and 24, buss 48, and to integrated circuit control board 36 through logic power bus 50.

Integrated circuit control board 36 provides the time engaging logic for both the winding cells 20 and MFV's 22 and 24. More particularly, gating is provided to silicon control rectifiers (SCR) 38, or like means, which in turn control the outputs 28 and 30 of winding cells 20 with respect to output busses A and B. Winding cells 20 can be connected across output busses A and B in either positive or negative polarity states. In FIG. 19 it is further seen that a second set of SCR's 40 or like means provide the necessary electronic control input to upper MFV's 22 and lower MFV's 24. The MFV's are even in number, divided equally between the upper and lower MFV's. Also shown in FIG. 19 is load sensing means 52 with leads A and B intended for connection of load 54. With respect to the time gating generated by IC control board 36, upon activation of input power, and of IC board 36, half of the winding cells 20 are rendered inaccessible to the flux from the pole magnet's magnetic field by reason of the activation of upper and lower MFV's of those winding cells. That is, by energizing selected MFV's relative to other MFV's, the path or motion of lines of magnetic flux, as above described, can be controlled. It has been found that many different control sequences may be useful in furtherance of the underlying concept of the instant invention.

Operational sequence initiates when IC board 36 generates appropriate signals to the MFV's to begin rotation of the magnetic field by turning on the normally magnetically open (unenergized) MFV's and controlling the trailing edge cells in sequence, while simultaneously turning-off normally magnetically open (unenergized) MFV's and controlling the leading edge cells in such sequence control as to create a time domain pattern with respect to energized or unenergized MFV states such that maximum efficiency is achieved with regard to the time constants of the various components of the transformer. The intended direction of field rotation establishes which cells are on the leading or trailing edge of the magnetic field rotation.

The I.C. board 36, concurrently with MFV energization and de-energization, is also in charge of gating said SCR's 38 and 40 to control the on-line, off-line status of each winding cell 20 to outputs 28 and 30 thereto, as well as the inputs 32 and 34 to the upper and lower MFV's 22 and 24 respectively. Certain output waveforms and polarities would not require SCR control of winding cells 20.

It is to be appreciated that the active winding cells can be connected either in series or parallel, as may be governed by the power requirements of the driven load 54. Additionally, the output (the secondary) A-B can be taken as either an alternating or direct current.

In operation, inputs to the I.C. board 36 provide information related to the input power available as well as in regard to the load power requirement sensed by load sensing means 52. Such information is used to alter the control signal frequency via a performance curve to thereby "throttle" the transformer block assembly to the required output power level. It is to be noted that the power output of the present transformer is related to the angular velocity of the field rotation (given initial values of field strength and material constants). As such, the angular velocity of field rotation can be matched to the requirement of the transformer load 54 at the output A-B. It is also noted that the proposed design geometry and construction set forth above is adapted to the natural geometry of the magnetic field of magnet 10 of its related pole shoes 12 and 14, taken as a whole.

The A-B output terminals, together with any components on the buss at any given time, form the transformer secondary circuit.

All space within the dimensional envelope of the transformer is involved directly with the device's operation. More particularly, there does not exist any air gaps or unused space within the dimensional envelope (internal to outer shield 26). Further, magnetically communicating elements of the transformer are separated by distances between flux lines related to the force or repulsion (magnetic compression) therebetween.

Primary power 60 IC 42 to logic power supply provides IC controller 36 with a required supply of voltage to enable-logic execution, SCR gating signal generation, MFV gating signal generation, and the external sensor 52. The electromagnetic pole magnet 10 is powered by the application of primary power 60 to windings 13, and forms the primary of the transformer whose inputs are C-D. State of the art technology renders possible placement of all control circuitry directly within a hermetically sealed dimensional envelope.

Accordingly, while there has been shown and described the preferred embodiment of the present invention it is to be appreciated that the invention may be embodied otherwise that is herein specifically shown and described and that, within such embodiments certain changes may be made within detail and construction thereof without parting from the underlying idea of this invention within the scope of the claims appended herewith.

Having thus described our invention, of what we claim as new, useful and non-obvious and, accordingly, secure by Letters Patent of the United States of America is:

1. A flux compression transformer comprising:

a) an electromagnetic envelope having a magnetic axis and a pattern of concentric flux lines, said envelope defined by a tordial winding, inputs to said winding comprising a primary of the transformer;

b) within said pattern of flux lines, a plurality of polarly disposed control means for spatially displacing said flux lines relative to said electromagnetic envelope, said means being mechanically stationary relative to said envelope; and c) corresponding to said control means, inductive means in electromagnetic communication with said flux lines, said inductive means being mechanically stationary relative to said envelope, outputs of said inductive means comprising a secondary of the transformer, whereby displacement of said flux lines relative to said inductive means will cause a flow of electrical energy therein and, resultant therefrom, a transformed power output across said secondary.

2. The transformer as recited in claim 1 in which said electromagnetic envelope comprises a permanent pole magnet within said tordial winding.

3. The transformer as recited in claim 2, in which the polarity of the magnetic axis of said permanent pole magnetic is co-incident with the polarity of the magnetic axis of said tordial winding.

4. The transformer as recited in claim 1, in which said control means comprises:

means for effecting selectable polar displacement of said flux lines relative to said magnetic axis.

5. The transformer as recited in claim 3, in which said control means comprises:

means for effecting selectable polar displacement of said flux lines relative to said magnetic core.

6. The transformer as recited in claim 5, in which said control means comprises:

means for creating time domain patterns of respectively enhanced and decreased magnetic reluctance across said control means.

7. The transformer as recited in claim 6, in which said control means further comprises:

interdigitating radial layers of electrically conductive paramagnetic material.

8. The transformer as recited in claim 6, in which said inductive means comprises:

an inductive structure embedded within a magnetically tri-axial paramagnetic material.

9. The transformer as recited in claim 6 in which, said inductive means comprises a plurality of radially disposed sheets comprising planer mesh-like structures.

10. The transformer as recited in claim 6 in which, ends of said magnetic axis, each comprise a radial pole shoe having a radial dimension greater than the radial dimension of said magnetic envelope.

11. The transformer as recited in claim 10 in which, said inductive means comprises:

a plurality of winding cells disposed radially about said core and disposed axially between said pole shoes, and in which upper and lower pairs of said control means are disposed longitudinally between each axial end of said winding cells and respective pole shoes.

12. The transformer as recited in claim 11, further comprising:

a plurality of insulating means interdigitally disposed between of said winding cells.

13. The transformer as recited in claim 12, further comprising:

magnetic insulating means circumferentially surrounding said magnetic envelope.

* * * * *